United States Patent [19]

Nicolas et al.

[11] 3,941,067

[45] Mar. 2, 1976

[54] BAROMETRIC DRAFT REGULATOR

[75] Inventors: Nabil Y. Nicolas, Prescott; Christian G. Schmelzle, Brockville, both of Canada

[73] Assignee: Selkirk Metalbestos, Brockville, Canada

[22] Filed: Oct. 16, 1974

[21] Appl. No.: 515,342

[52] U.S. Cl. ..... 110/163; 236/45

[51] Int. Cl.[2] ..... F23L 13/00; F23N 3/00

[58] Field of Search ..... 110/162, 163; 236/45

[56] References Cited

UNITED STATES PATENTS

| | | | |
|---|---|---|---|
| 2,460,538 | 2/1949 | Schneider | 236/45 |
| 2,617,371 | 11/1952 | Resek et al. | 110/162 |
| 2,721,705 | 10/1955 | Patrick | 236/45 |
| 2,825,506 | 3/1958 | Steinen | 236/45 |
| 3,206,119 | 9/1965 | Steinen | 236/45 |

*Primary Examiner*—Kenneth W. Sprague

[57] ABSTRACT

An improved automatic draft regulator having significantly fewer parts than previous such devices, and comprising a frame adapted to fit into the flue pipe of a furnace, a gate pivotally mounted in the frame, and adjustable weight means pivotally connected to the gate and extending through it.

12 Claims, 3 Drawing Figures

BAROMETRIC DRAFT REGULATOR

This invention relates to an automatic draft regulator particularly adapted for use in a flue pipe in a fuel burning appliance.

It is known in devices for regulating the draft in a fuel burning appliance, particularly a domestic furnace, to utilize a device which is controlled by adjustable weight and counterweight and which is located on the flue pipe often in a horizontal branch pipe provided for the purpose. Previously, such devices have had a number of shortcomings. Important among these, for example, is that the relatively large number of parts and the consequent difficulty of assembly resulted in increased production costs for both the individual parts and the regulator itself.

The basic components of a barometic draft regulator are a frame with an opening therein, a gate to close the opening, hinge means on which the gate swings and an adjustable weight and counterweight for control purposes. Various additional parts are required as fastening means support means, etc., to make the device operational.

BRIEF SUMMARY OF THE INVENTION

The present invention provides an automatic draft regulator having in the order of half as many parts as previous regulators and in having parts which are very easy to construct and assemble. The device comprises (a) a frame adapted to be mounted on the flue pipe of a fuel burning appliance, (b) an opening in the frame, (c) a gate pivotally mounted on hinges within the said opening, (d) an opening in the gate, and (e) weight means pivotally connected to the said gate and extending through the opening therein.

In one aspect of the present invention improved weight means are provided for control purposes. The counterweight, normally a part of such devices, is eliminated. The weight means, comprising a simple one-piece construction in a substantially planar configuration of uniform thickness, pivots through the slot in the gate in a plane perpendicular or inclined to the gate and with the pivot means offset from the plane of the gate. These factors all contribute markedly to ease of production and hence lower costs. In addition simpler and more efficient weight adjustment is provided. In one embodiment, the weight means has an embossment thereon to increase frictional engagement with the slot in order to facilitate selective variation of the centre of gravity of the weight about the gate. In addition in that case the pivot means may consist of a rivet and bearing means providing additional friction to ensure that a selected position of the weight is maintained. In a second embodiment the pivot means may consist of a nut and bolt, providing a locking mechanism for the weight. Furthermore, the weight means may be designed with an upward bend at the outer edge, said bend also serving as a simple handle for ease of adjustment. The weight means serves further as a stop against the frame to define the limit of swing of the gate in the "open" configuration.

The limits of adjustment of the weight means may be defined by stops against the edge of the slot, being in one direction the upward bend in the weight means and in the other direction, a deeper depression in the embossment means.

The weight means gains added planar stability through a strengthening of the slot edges by means of depressions or embossments at the edges.

To further facilitate efficient operations of the device, new hinge means are provided whereby the gate swings on point contacts, thus reducing friction to a minimum. In addition the hinges are designed to prevent lateral movement of the gate with consequent binding between gate and frame.

DESCRIPTION OF THE DRAWINGS

The device and its operation may be more precisely defined by reference to the drawings.

DETAILED DESCRIPTION

Figure 1:
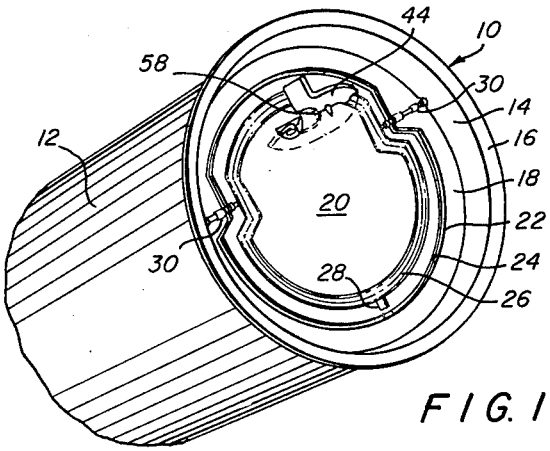
FIG. 1 is a perspective view.
Figure 2:
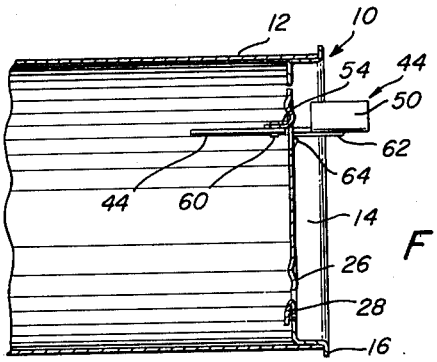
FIG. 2 is a vertical half section.
Figure 3:
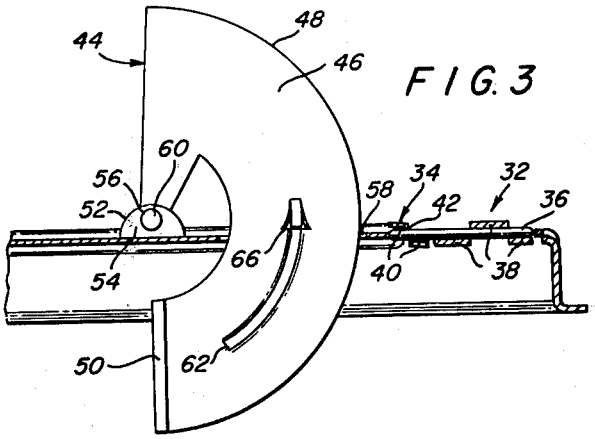
FIG. 3 is a partial section showing the weight means and the hinge means.

The draft regulator consists of a frame 10 mounted in a horizontal branch pipe 12, an opening 22 in the frame 10, a gate 20 pivotally mounted in the opening 22, an opening in the gate 20, and weight means 44 pivotally connected to gate 20 and extending through the slot therein.

For the purpose of more detailed illustration of the device, with reference to the drawings, the frame 10 is shown mounted on a horizontal branch 12. The frame 10 consists of a circular collar 14 which fits into the interior of the branch 12. The collar is held in place by frictional engagement with the branch. The outer end of the collar 14 is curled outward forming a circular flange 16 which engages the end of the branch pipe 12 and ensures a proper installation of the frame in the pipe. The innermost end of the collar 14 is curved inwards at 90° to form a vertical plane surface 18 having an opening 22. The gate is shaped to close the opening 22. The edge 24 of the gate 20 follows the contour of the opening 22. On the gate 20 is embossed an S-shaped curve 26 that follows the edge 24 at a short distance from it. The embossment serves to give added strength to the gate. From the bottom part of the gate a square tongue 28 is lanced and bent over 180° to stop the gate 20 against the surface 18 of the frame 10. A clearance is maintained between the gate 20 and the frame 10 so the gate can swing freely through the opening 22 on the 2 horizontal hinges 30 located above the centre of the gate 20. This clearance is conveniently provided since contraction of the gate edges occurs when the S-embossment is formed.

Each hinge 30 consists of a fixed support 32, a bearing 34 and a pin 36. The fixed support 32 is formed of three semi-circular depressions 38 pressed alternately in opposite sides of the vertical surface 18. The bearing 34 consists of two tapered curved depressions 40 formed in the gate between the edge 24 and the S embossment 26 and alternately on opposite sides of the gate 20. The pin 36 has both ends tapered in order to be driven through the depressions 38 of the fixed support 32 and to fit tightly through the friction. In addition, deformed semicircular depressions 39 prevent the pin 36 from sliding out of place. The diameter of the throat 42 of the bearing 34 is slightly larger than the pin diameter. The bearing is designed with a taper in order to achieve a point contact between the pin 36 and the bearing throat 34 reducing the friction between them to a minimum. The S embossment 26 provides a thrust bearing for the gate 20: the lateral motion of the gate is stopped as soon as the inner end of the pin 36 hits the S embossment 26.

The adjustable weight 44 is of a substantially planar configuration comprising a curved elongate area 46 having a segmental area 48 at one end and an upward bend 50 at the other end. This bend may serve as a convenient handle for ease of adjustment. A hole 52 is located in the segmental area 32 to allow attachment to the pivot means.

Above the centre line of the hinges 30 a tab 54 is lanced from the gate and bent back at 90°. A hole 56 is punched in the tab 54.

Offset from said tab 54 and substantially parallel thereto an opening or slot 58 is punched in gate 20. The adjustable weight 44 pivots perpendicular to the gate 20 through the slot 58 about a means 60 that holds the weight 44 to the tab 54. A curved embossment 62 in the weight 44 increases frictional engagement between the slot 58 and the weight 44. The S embossment 26 passes through the edges of slot 58, and together with a depression 64 in the gate 20 at the edge of the slot 58, adds lateral stability to the weight 44.

The adjustable weight 44 stops the gate 20 against the frame 10 when the gate 20 reaches the limit of opening, thereby preventing the gate from turning over.

The limits of adjustment of the weight may be defined in one direction by the upward bend 50 and in the other direction by a stop formed by increasing at a point 66 the depth of the embossment 62 in the weight 44.

It is to be noted that the drawings refer to only one configuration of the invention. Many features can be varied without departing from the inventive ideas. For example, the pivot axis of the gate, the opening in the gate, and the weight means might all be located below the centre of gravity of the gate. The weight means may be inclined to the plane of the gate. The opening in the gate may be inclined to or perpendicular to the pivot axis. It can thus be seen that various configurations of the basic components are possible.

What we claim as our invention is:

1. An automatic draft regulator comprising (a) a frame adapted to be mounted on the flue pipe of a fuel burning applicance; (b) an opening in the frame; (c) a gate pivotally mounted on hinges within the opening; (d) an opening in the gate; and (e) a substantially planar plate member pivotally connected to the gate and extending through the opening therein, said plate member being of substantially uniform thickness and acting as a weight means for balancing said gate.

2. The automatic draft regulator of claim 1 wherein the plane of the plate member is substantially perpendicular to the plane of the gate.

3. The automatic draft regulator of claim 1 wherein both the pivotal axis of said gate and the opening in said gate are above or below the centre of gravity of the gate when in its useful position.

4. The automatic draft regulator of claim 1 wherein said opening in the gate is substantially parallel to the pivotal axis of the gate.

5. The automatic draft regulator of claim 1 wherein the plate member has an embossment thereon for increasing the frictional engagement between the weight means and said opening in the gate.

6. The automatic draft regulator of claim 5 wherein said embossment has an increased depth at one point therealong which acts as a stop and said plate has an upward bend therein at another point therealong whereby the limits of rotation of the plate member through the gate are defined.

7. The automatic draft regulator of claim 1 wherein the gate has embossed thereon embossment having an S-shaped cross-section that follows the edge of the gate at a short distance therefrom.

8. The automatic draft regulator of claim 7 wherein a part of the opening in the gate extends through the embossment and said gate has a further embossment therein at the edge of the opening.

9. The automatic draft regulator of claim 1 wherein a tab is pressed from the gate and a rivet pivotally connecting said plate member to said tab, said rivet providing a predetermined frictional force between the plate member and bearing means.

10. The automatic draft regulator of claim 1 wherein the plate member abuts the frame and stops the gate.

11. The automatic draft regulator of claim 1 wherein the gate has embossed thereon an S-shaped embossment which follows the edge of the gate at a short distance therefrom, and wherein each of said hinges includes a fixed support, a pin fixed in said support, a deformed semi-circular depression in the frame, and bearing means, said bearing means comprising two curved, tapered depressions in opposite sides of said gate whereby a point contact is provided.

12. The automatic draft regulator of claim 11 wherein said pin abuts at one end against said S-embossment and at the other end against said deformed semi-circular depression.

* * * * *